US008187069B2

(12) United States Patent
Poisson

(10) Patent No.: US 8,187,069 B2
(45) Date of Patent: May 29, 2012

(54) ONLINE GAMING SYSTEM FOR SIMULATING A SOCCER GAME USING AN ELECTRONIC DECK OF PLAYING CARDS

(76) Inventor: Renald Poisson, Houston, TX (US)

( * ) Notice: Subject to any disclaimer, the term of this patent is extended or adjusted under 35 U.S.C. 154(b) by 334 days.

(21) Appl. No.: 12/563,363

(22) Filed: Sep. 21, 2009

(65) Prior Publication Data

US 2010/0075728 A1 Mar. 25, 2010

Related U.S. Application Data

(60) Provisional application No. 61/099,147, filed on Sep. 22, 2008.

(51) Int. Cl.
*A63F 1/04* (2006.01)

(52) U.S. Cl. ..... 463/11; 273/247

(58) Field of Classification Search ..... 273/247; 463/4, 9, 40, 11, 20, 25
See application file for complete search history.

(56) References Cited

U.S. PATENT DOCUMENTS

| | | | | |
|---|---|---|---|---|
| 4,662,635 | A * | 5/1987 | Enokian | 463/31 |
| 5,769,714 | A * | 6/1998 | Wiener et al. | 463/3 |
| 5,772,512 | A * | 6/1998 | Chichester | 463/40 |
| 5,779,549 | A | 7/1998 | Walker et al. | |
| 5,906,370 | A * | 5/1999 | Poisson | 273/247 |
| 6,012,721 | A * | 1/2000 | Harnish | 273/298 |
| 6,135,885 | A * | 10/2000 | Lermusiaux | 463/20 |
| 6,758,754 | B1 | 7/2004 | Lavanchy et al. | |
| 6,786,818 | B1 * | 9/2004 | Rothschild et al. | 463/20 |
| 6,800,027 | B2 * | 10/2004 | Giobbi et al. | 463/24 |
| 7,785,193 | B2 * | 8/2010 | Paulsen et al. | 463/25 |
| 7,883,403 | B2 * | 2/2011 | Low et al. | 463/16 |
| 2003/0100370 | A1 * | 5/2003 | Gatto et al. | 463/42 |
| 2004/0002374 | A1 * | 1/2004 | Brown et al. | 463/20 |
| 2006/0252530 | A1 | 11/2006 | Oberberger et al. | |
| 2008/0012219 | A1 * | 1/2008 | Abrahamson | 273/146 |
| 2008/0096659 | A1 * | 4/2008 | Kreloff et al. | 463/39 |
| 2008/0242400 | A1 * | 10/2008 | Okada | 463/25 |
| 2009/0085297 | A1 * | 4/2009 | Morales | 273/298 |

OTHER PUBLICATIONS

Mike Douglas, Soccer Cards, Jun. 1, 2006, http://www.manwithnomouth.nildram.co.uk/index.htm.*

Todd Bardwick, Denver Broncos and Chess, Jul. 1999, http://coloradomasterchess.com/Informant/Denver%20Broncos%20and%20Chess.htm.*

DakStats, DakStats Soccer, Jul. 3, 2008, http://dakstats.daktronics.com/Pages/Soccer.aspx.*

* cited by examiner

*Primary Examiner* — Dmitry Suhol
*Assistant Examiner* — Jason Yen
(74) *Attorney, Agent, or Firm* — Buskop Law Group, PC; Wendy Buskop

(57) ABSTRACT

An online gaming system for simulating a soccer game comprising a server with a processor, a network in communication with the server, at least one client device in communication with the network, wherein the at least one client device has an input device, a display device, and a monetary acceptance feature, and a database in communication with the processor. The database comprises an electronic deck of playing cards comprising offensive play cards and defensive play cards and an electronic deck of special plays cards. Computer instructions in the database instruct the processor to permit input of bets, electronically deal cards from the electronic decks, designate offensive and defensive players, permit selection of cards by players, make game plays using a chess like strategy, determine game outcomes based on the selected cards, and award winnings based on bets and game outcomes.

20 Claims, 1 Drawing Sheet

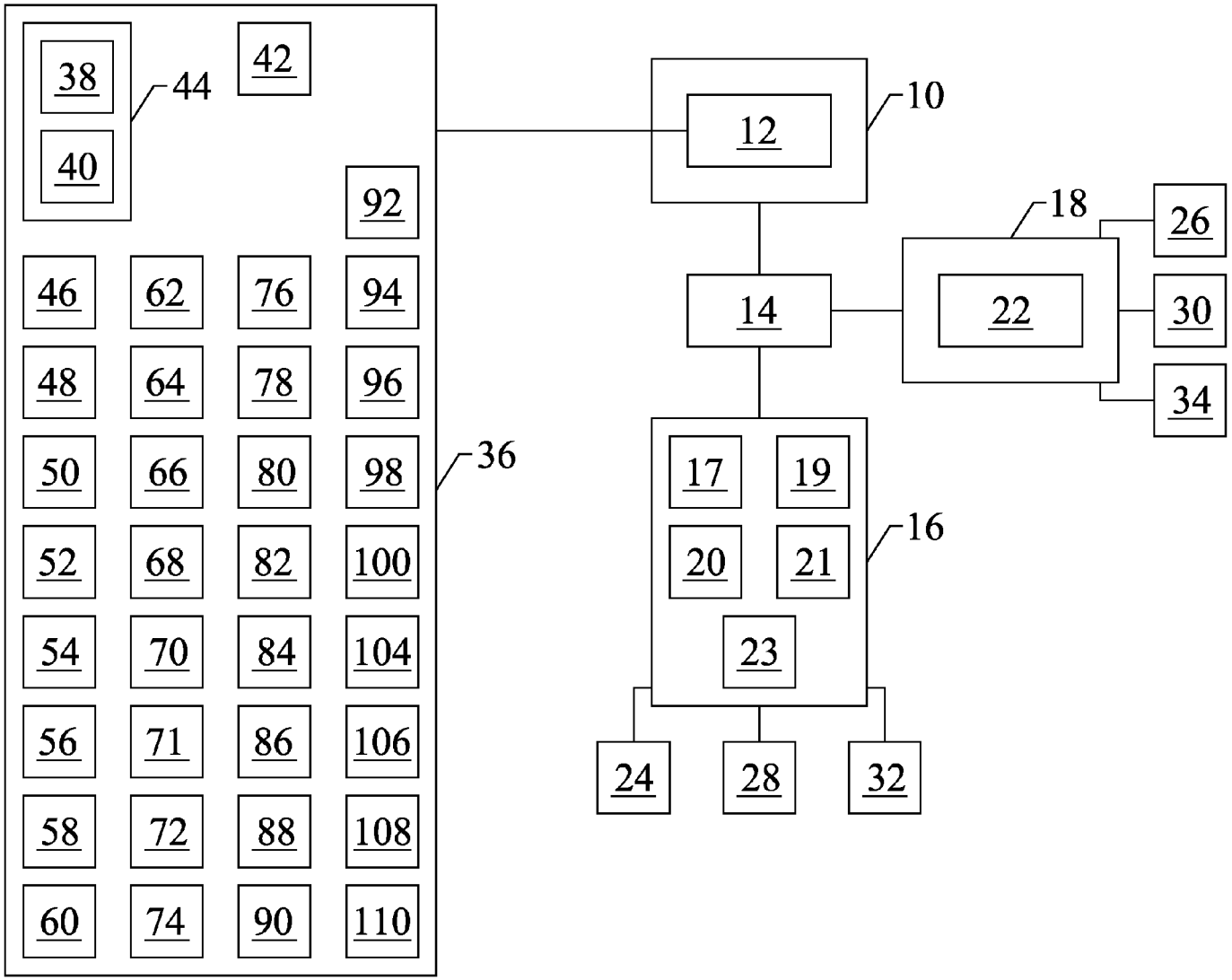
10
12
14
16
17
18
19
20
21
22
23
24
26
28
30
32
34
36
38
40
42
44
46
48
50
52
54
56
58
60
62
64
66
68
70
71
72
74
76
78
80
82
84
86
88
90
92
94
96
98
100
104
106
108
110

ONLINE GAMING SYSTEM FOR SIMULATING A SOCCER GAME USING AN ELECTRONIC DECK OF PLAYING CARDS

CROSS REFERENCE TO RELATED APPLICATIONS

The present application claims priority and the benefit of co-pending U.S. Provisional Patent Application Ser. No. 61/099,147; Entitled "Online Gaming System for Simulating a Soccer Game," filed on Sep. 22, 2008.

FIELD

The present embodiments generally relate to an online gaming system for simulating a soccer game. The simulated soccer game closely follows how professional soccer games are played and includes a monetary acceptance feature for placing bets based on game outcome.

BACKGROUND

A need exists for an online gaming system that simulates a game of soccer and that closely follows the manner in which professional soccer games are played, while enabling users to experience the simulated soccer game on a "pitch" from a home computer, a public computer, or a gaming machine.

A further need exists for an online gaming system that provides a simulated game of soccer that uses electronic cards, thereby incorporating card game elements and strategies, such as bluffing, learning playing strategies of opponents, reading opponents to determine bluffs, counting cards, and the confrontation and competitive aspects of popular card games. The online soccer game allows the user to use chess piece like moves, such as the moves of a bishop, the moves of a rook, the moves of a queen to simulate moves on a soccer field which is also termed "the pitch" herein.

A need also exists for an online gaming system for providing a simulated game of soccer that allows users to place bets and receive winnings based on odds and game outcomes, in the style of popular slot and video card machines.

The present embodiments meet these needs.

BRIEF DESCRIPTION OF THE DRAWINGS

The detailed description will be better understood in conjunction with the accompanying drawings as follows:

FIG. 1 depicts a schematic drawing of the components of an embodiment of the present system.

The present embodiments are detailed below with reference to the listed FIGURE.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to an online gaming system for simulating a soccer game that combines game-play and finesse elements found in popular card games with odds and gambling elements found in slot and video card games.

The present system provides the benefit of enabling one or more users to participate in a simulated soccer game that closely follows the manner in which professional soccer games are played.

Offensive cards representing nearly all types of plays used in professional soccer can be played. Each offensive card indicates an outcome, such as a certain number of yards kicked and the direction of movement, diagonal, horizontal, vertical, or a horizontal and vertical move. The first card in the play can be an offensive play card.

Defensive cards having corresponding types of plays indicated thereon can be used to counter offensive cards, negating a gain of yards, causing a loss of yards, or providing other special instructions.

After a defensive card is played, it can be contemplated that computer instructions can instruct the processor to permit selection of a second card by the soccer defensive player for discard or in response to the offensive play card, and to electronically deal the soccer defensive player a replacement card from the electronic deck of playing cards. It is also contemplated that the computer instructions in the database can instruct the processor to determine the game outcome based on playing of the first and second cards.

After a defensive card is played, it can be contemplated that computer instructions instruct the processor to move the goalie of the soccer player at least one goalie movement, which is one space in any direction, diagonal, forward, back, or sideways.

Special plays cards can be dealt in certain circumstances, to simulate the results of special play plays, such as goal attempts.

Through use of a database in communication with a network-accessible server, the present system can be accessed directly or remotely by any number of users, individually or simultaneously, for supporting both competitive play between human opponents and play against a simulated player controlled by the server processor.

The present system can enable users to enjoy a simulated game of soccer that incorporates both card game elements, movements from chess with accompanying strategies and gambling elements, from the comfort of a home computer, or using publicly accessible machines in arcades, casinos, and other similar locations.

The present system is advantageously easy to utilize and can permit use of any type and any number of input devices, including a keyboard, a mouse, a touch screen, or other similar input devices.

Through use of computer instructions, the present system can automatically randomize and deals cards, and a user need only select visible cards depicted on a display device to cause the simulated soccer game to progress. The present system can automatically deal replacement cards, as necessary, and can perform all necessary processes and calculations to determine a game outcome based on the selected cards.

Specifically the computer instructions can allow the user to designate a soccer offensive player and a soccer defensive player.

The computer instructions can allow the electronic dealing of a first of possibly several cards from the deck to a first player and display the cards on the display device of the first player, and then deal a second group of at least one card from the electronic deck of playing cards to a second player, without showing either player the other's cards.

The present system provides education relating to the sport of soccer to players and onlookers in a fun and entertaining manner, using the strategic and finesse-based elements of card gaming. It teaches strategy of a chess game while the fun and fast thrills of soccer.

The present system can include a server having a processor, which can be an Intel™ processor, an AMD™ processor, or another similar type of processor able to execute computer instructions.

One or more networks can be in communication with the server. Useable networks can include the internet, an intranet, a local area network, a wide area network, a virtual private network, a satellite network, a cellular network, other similar networks and combinations thereof.

At least one client device can communicate with the processor through at least one user interface in communication with the network. Each client device can include one or more input devices, display devices, and a monetary acceptance feature.

Client devices can include computers, dumb terminals and/or gaming machines in communication with the network, or other devices able to accept input, display output, and communicate with a network, such as a personal digital assistant, a cellular telephone, and similar devices.

It can be contemplated that useable input devices can include a keyboard, a mouse, a keypad, a touch screen, a microphone, speakers, speech-to-text software, and other similar devices.

Monetary acceptance features can include means for accepting credit cards and debit cards, such as card readers, means for accepting currency, such as bill and coin insertion slots, means for accepting facility-specific credits, such as readers for cards issued by casinos, or combinations thereof. It is also contemplated that one or more input devices can also function as a monetary acceptance feature. For example, a computer keyboard or a keypad on a cellular telephone could be used to input a credit card or debit card number and other information necessary to process charges. A mouse or touch screen can also be used to select numbers to input credit card or debit card information.

The present system can also include a database in communication with a processor.

The database's electronic deck of playing cards can include both offensive play cards and defensive play cards used to simulate plays by an offensive soccer team and defensive plays to counter the offensive plays.

Offensive play cards can include pass cards, which display thereon a type of soccer running play and a result, which can include a gain of yards. In an embodiment, pass cards can include free kicks, free kick missed, kicked goals, kicked goals missed, non-hand non-kicked goals (such as when the ball is bounced off the head or other "fair" body part and a goal is made), non-hand non-kicked goals missed, in bounds pass, out of bounds kick, side kick, or at least one penalty, such as a personal foul, tripping, fighting, using hands, or similar known regulation soccer penalties.

Offensive play cards can further include penalty cards, which can display thereon a type of soccer penalty called against a defensive team. Each penalty card can include a penalty name and a result, such as a gain or loss of yards and/or special instructions. In an embodiment, penalty cards can include defensive offside cards.

It can be contemplated that a soccer offensive player can attempt to play offensive play cards for which a soccer defensive player lacks a responsive card, while the soccer defensive player attempts to strategically predict and/or coax certain offensive play cards to be played.

For example, a soccer defensive player can elect to avoid play an intercept card because an offensive soccer player is adjacent the defensive player's goal and in line to be blocked by the defensive player's goalie, so in response to an offensive play card reading "side kick" of the soccer offensive player the defensive player instead discards a card of the player's choice.

As play progresses, it can be contemplated that players can track past plays and count cards, facilitating the prediction of future plays.

It can also be contemplated that computer instructions can instruct the processor to tally and display on a display device all the free kicks, free kicks missed, kicked goals, and kicked goals missed, all non-hand non-kicked goals, and all non-hand non-kicked goals missed, in bounds pass, out of bounds kick, side kick, and even penalties or fouls depending of national soccer league nomenclature is the preferred term.

Defensive play cards can also include pass cards that display a type of passing play corresponding to one or more types of passing plays listed on offensive play cards, paired with a result or instructions, such as a cross field kick.

Defensive play cards can further include special cards, such as a cross field kick interception card.

Special cards can also include an instruction, causing the offensive team to be designated as the defensive team, and vice versa.

Defensive cards can additionally include penalty or "foul" cards, which include a type of soccer penalty called against an offensive team, and a result, such as a loss of yards and/or special instructions. In an embodiment, penalty cards can include a personal foul, which can result a free kick for the other player.

The database can also include an electronic deck of special plays cards, used to simulate special plays undertaken by both offensive and defensive soccer teams. It is contemplated that cards from the electronic deck of special plays cards can be dealt randomly when placed in play, rather than selected by players for use.

It can be contemplated that a player can elect to have a special plays card electronically dealt in lieu of playing an offensive or defensive soccer card to simulate special plays, such as a tripping special play which results in a tallying of at least one personal foul on the player. It is contemplated that there are a limited number of personal fouls permitted until the player is terminated from the game, such as 5 personal fouls.

The database can further include computer instructions for instructing the processor to permit input of a bet from the input device and the monetary acceptance feature through the user interface and the network to the server. For example, a user can insert a credit card into a credit card reader, then use a keyboard or touch screen to enter and confirm a bet amount.

Bets accepted by the processor can include bets relating to the winner of the game, bets specifying which team will have more goals at a certain goal in the game, or similar bets relating to the game outcome. Bets can also be placed relating to amounts of goals scored by either or both simulated soccer teams, the spread in goals between the two simulated teams, or other bets relating to goal totals. Bets can also be placed relating to individual plays and/or game outcomes, such as whether the next card played will result in goals scored, a gain or loss of yard, a turnover, or any other possible game outcome.

Bets can include single-play bets, such as a bet that the next card played will result in a free kick, a successful pass, a failed pass, a successful goal, a missed goal or other similar game outcomes.

Bets can also include bets that persist for a simulated possession, which can include up to four simulated plays, such as a bet that the current possession will result in a successful goal, a missed goal, or other game outcome.

Bets can further include bets that persist for an extended portion of the simulated game of soccer, such as a half, or for the duration of the simulated game of soccer. Such bets can include a bet predicting which team will win the game, one or more goal totals or goal spreads at certain goals in the game (the over or under), whether the game will be tied at the end of regular play and extend into overtime, which team will win during overtime, independent or comparative predictions of total values of various game statistics, such as total goals made or missed or other similar types of bets.

Additional computer instructions can instruct the processor to electronically deal a first plurality of cards from the electronic deck of playing cards and display the first plurality of cards on the display. It is contemplated that the first plurality of cards constitutes the user's hand. A user's hand can include at least 5 cards and up to 11 cards, each card representing the number of players on the team which include 2 forwards, 1 goalie, 4 midfield, and 4 defensive men—an 11 person team. Other configurations can be used, such as 5 players with 1 goal tender for a total of 6 players which is common for indoor soccer play. For example, a five-card hand can be used when playing a simulated soccer game using a video card machine at a casino, while a card hand, representative of the number of participating players on a soccer team, can be used in an internet-based game or a high roller game at a casino.

Computer instructions can also instruct the processor to electronically deal a second plurality of cards from the electronic deck of playing cards to a second player. The second player can be a simulated player controlled by the processor. In an embodiment, the second plurality of cards can instead be dealt to a second user playing competitively with a first user.

Computer instructions can then instruct the processor to designate a soccer offensive player and a soccer defensive player.

Alternatively, the offensive/defensive designation can be performed randomly.

In yet another embodiment, the computer instructions can permit selection by a user using the input device indicating whether the user wishes to begin play as the soccer offensive player or the soccer defensive player.

In an embodiment, computer instructions in the database can be used to instruct the processor to permit selection of a coin toss outcome by a user, to simulate a coin toss and display the coin toss outcome, and to compare the coin toss outcome with the selected outcome, permitting designation of the soccer offensive player and soccer defensive player by the user if the coin toss outcome matches the selected outcome. It is contemplated that a simulated coin toss can be used to determine the beginning soccer offensive player and soccer defensive player to simulate the manner in which beginning offensive and defensive teams are designated in a professional soccer game.

The database can also include computer instructions for instructing the processor to permit selection of a first card by the soccer offensive player and to display the first card on the display, wherein the first card can be a kick pass instructing the player to move two spaces forward, or a kick pass moving two spaces left, or a kick pass moving two spaces right.

Computer instructions can also instruct the processor to electronically deal to the soccer offensive player a replacement card for the first card from the electronic deck of playing cards such as a head pass diagonal 10 spaces, which can place the player out of bounds, permitting the second player to obtain possession.

It can be contemplated that typically, the soccer offensive player can play an offensive play card to attempt to gain a number of yards and/or score goals.

In the event that the soccer offensive player selects an offensive play card, computer instructions can be used to instruct the processor to permit the soccer defensive player to select a corresponding second card and to play the corresponding second card to stop the corresponding offensive play.

The second card can be selected for discard, or the second card can be a defensive play card having a type of play indicated thereon that corresponds to the type of play indicated on the offensive play card.

Even if the second card is discarded, it can be contemplated that computer instructions can instruct the processor to display the second card on the display device, to facilitate counting of cards and tracking of possible future plays.

In the event that the soccer defensive player selects a defensive play card having a type of play corresponding to the offensive play card, both the offensive play card and the defensive play card are used to determine a game outcome or a movement of a player (in any direction).

Computer instructions can then instruct the processor to deal a replacement card for second card.

It can also be contemplated that the soccer offensive player can perform a tactic known as "Clutching," by playing a defensive play card rather than an offensive play card. The soccer offensive player can voluntarily incur the negative consequences of the selected defensive play card, and computer instructions then instruct the processor to deal a replacement card for the selected defensive play card. This strategy is useful when a player wishes to intentionally lose one or more individual plays to cause a desirable long term game outcome, such as a resulting specified goal total on which the player has placed a bet.

"Clutching" is also useful when a soccer offensive player lacks sufficient offensive play cards to score goals but possesses special defensive play cards that can possibly cause a loss of possession of the ball when playing as the soccer defensive player.

If the soccer offensive player plays a defensive play card, it is contemplated that the soccer defensive player is not permitted to select a second card for discard or to select a second card to play in response for the first card.

Computer instructions in the database can instruct the processor to determine a game outcome based on the first card, and if played, the second card. Game outcomes can include a gain or loss of yards, or position in the field, which causes the soccer defensive player to be designated as the soccer offensive player and the soccer offensive player to be designated as the soccer defensive player, or other similar results. Generally there is an offensive third of the field, a defensive third of the field and midfield. Bets can be placed on position of the soccer player in the offensive third, the defensive third or midfield. Bets can be placed based on time of possession of the soccer ball by a player.

In an embodiment, computer instructions can instruct the processor to play a video, animation, or combinations thereof, that depicts a representation of the game outcome. For example, a video or animation of a player kicking unsuccessfully to a fellow player can be played when the soccer offensive and soccer defensive players play cards indicating such a result.

The database can also include computer instructions for instructing the processor to award winnings based on the bet and the game outcome.

In an embodiment, the database can include computer instructions for instructing the processor to permit selection of one or more cards by the soccer offensive player to be placed in an offensive time out hand, which can be stored in the database. The computer instructions can also permit selection of cards by the soccer defensive player to form a defensive time out hand, which can also be stored in the database.

Computer instructions in the database can then be used to instruct the processor to permit the soccer offensive player or the soccer defensive player to declare a time out during play, and to permit each player to select cards for exchange with selected cards from their respective time out hands. It can be contemplated that the computer instructions can instruct the processor to designate a limited number of times each player can declare a time out, such as twice per each half of the simulated game of soccer.

For example, a soccer defensive player can select five offensive play cards for placement in a time out hand, while retaining sufficient defensive play cards to cause a turnover, which designates the soccer offensive player as the soccer defensive player and the soccer defensive player as the soccer offensive player. At that time, the soccer offensive player, who was previously the soccer defensive player, can declare a time out and exchange one or more cards with the time out hand to acquire the offensive play cards that were placed in the time out hand.

A simulated game of soccer can be divided into halves, or other segments of time by automatically determining that each segment of time expires after a predetermined number of cards have been played. Generally most of the time, the soccer game will play continuously in the first half. Play is generally only stopped when the ball is out of bounds or a goal is made.

Users can also be permitted to select the length of each half, or other time segment, of the simulated soccer game. For example, each time the electronic deck of playing cards is exhausted, it can be declared that one half of the simulated game of soccer has expired. The present system can then electronically randomize the cards, electronically deal hands to each player, and begin the second half of play.

In an embodiment, computer instructions in the database can instruct the processor to permit the soccer offensive player to elect to perform a special plays play in lieu of selecting the first card. The computer instructions can then instruct the processor to electronically deal a first special plays card from the electronic deck of special plays cards and to display the first special plays card on the display solely to the player, without enabling a second player to view the card. The first special plays card can be used to determine the game outcome.

The game can be started midfield and a special plays card can be electronically dealt to represent an attempt to score a goal. The special plays card can then indicate whether goals are scored, or whether the simulated goal attempt was missed.

Computer instructions in the database can also be used to instruct the processor to permit the soccer defensive player to elect to perform a special plays response in response to the first special plays card. The computer instructions can instruct the processor to electronically deal a second special plays card from the electronic deck of special plays cards and display the second special plays card on the display. Computer instructions can then instruct the processor to determine the game outcome based on the first special plays card and the second special plays cards.

For example, a soccer offensive player can elect to have a first special plays card electronically dealt to simulate an attempt. The first special plays card can display a chess like movement of a player and the movement of the ball or another result or instruction associated with attempt. The soccer defensive player can then elect to have a second special plays card electronically dealt to simulate a change of possession.

The soccer defensive player can also elect not to have a second special plays card electronically dealt in response to the first special plays card. For example, to simulate a successful non hand header, the soccer defensive player can permit a simulated kick return attempt to take place.

It can be contemplated that the database can also include computer instructions for instructing the processor to display on the display device a simulated soccer field or "the pitch". "The pitch" is a term, which can be used to refer to the playing field. The simulated soccer field or "the pitch" can include a gridiron, a six yard box, eighteen yard box, midfield line, a midfield circle, corner arcs, one on each corner of the field, a goal indicator, a score indicator, a possession indicator, or combinations thereof.

Computer instructions can further instruct the processor to display on the simulated soccer field simulated offensive and defensive soccer teams, and a simulated game ball position.

Computer instructions can also instruct the processor to update positions of the players in the game, such as location of a corner arc for corner kicks, a score, a possession, or combinations thereof, which facilitate in predicting the game outcome.

This embodiment enables the simulated soccer game to be represented not only using cards and/or tabular means, but through graphical means as well.

It can also be contemplated that computer instructions in the database can also instruct the processor to display on the display, a goals made indicator, a goals missed indicator, corner kicks, fouls outside the 18 yard box, fouls outside the 6 yard box, awards of direct kicks, awards of indirect kicks, plays related to direct kicks, plays related to indirect kicks, or other similar indicators for displaying game information and statistics, or combinations thereof.

Computer instructions can further instruct the processor to update information and values indicated by any of the indicators, plays, goals, penalties and fouls.

In an embodiment, the present system can also include a secondary bonus slot game. Computer instructions in the database can instruct the processor to display the secondary bonus slot game if one or more play achievements occur. Play achievements can include scoring one or more goals, achieving one or more offensive or defensive plays, scoring, or any other possible game outcome.

The computer instructions can then instruct the processor to permit input of a bonus bet from the input device and the monetary acceptance feature through the user interface and network to the server.

The computer instructions can further instruct the processor to electronically spin reels of the secondary bonus slot game and stop the reels, then award bonus winnings based on the bonus bet and the play achievements.

Referring now to FIG. 1, a schematic drawing of an embodiment of the present system is depicted.

FIG. 1 depicts a server (10) having a processor (12). The server (10) is in communication with a network (14). While FIG. 1 depicts the server (10) in communication with a single network (14), it is contemplated that the server (10) can be in communication with any type and any number of networks simultaneously.

A first client device (16) and a second client device (18), having a first user interface (20) and a second user interface (22), are shown in communication with the network (14). The first client device (16) has a first input device (24) and a first display device (28). The second client device (18) has a second input device (26) and a second display device (30).

While each client device is depicted having a single input device and display device, it is contemplated that each client device can include any type and number of input and display devices for example, a component of each client device can be a ticket printer (17), a blue tooth connection (19), an infra red connection (21) and a denomination indicator/change switch (23).

The first client device (16) can include a first monetary acceptance feature (32). The second client device (18) can include a second monetary acceptance feature (34).

A database (36) is shown in communication with the processor (12). The database (36) can be resident in the server (10) and in direct communication with the processor (12). The database (36) can also be remote from the server (10) and in communication with the processor (12) via the network (14).

The database (36) is shown containing an electronic deck of playing cards (44), which can include both offensive play cards (38) and defensive play cards (40) that have been combined and electronically randomized to form the electronic deck of playing cards (44).

The database (36) is also shown containing an electronic deck of special plays cards (42).

Computer instructions (46) in the database (36) are useable to instruct the processor (12) to electronically randomize the electronic decks of playing cards (44). Electronically randomizing the cards can include simulating shuffling of the decks and storing the shuffled order of the cards in the database (36). Electronically randomizing the cards can also include randomly determining the identity of each card at the time it is dealt.

Computer instructions (48) in the database (36) instruct the processor (12) to permit input of a bet using one of the input devices (24, 26) and one of the monetary acceptance features (32, 34). It is contemplated that the bet can be stored in the database (36) until the game outcome is determined and winnings can be awarded.

Computer instructions (50) in the database (36) can instruct the processor (12) to electronically deal a first plurality of cards from the electronic deck of playing cards (44) and to display the first plurality of cards on the first display device (28). The first plurality of cards is contemplated to constitute a user's hand.

Computer instructions (52) in the database (36) can also instruct the processor (12) to electronically deal a second plurality of cards from the electronic deck of playing cards (44) to a second player. The second plurality of cards constitutes the second player's hand. The second player can be a human opponent of the first user, or the second player can be a simulated player controlled by the processor (12). If the second player is a human opponent, the second plurality of cards can be displayed on the second display device (30). It is contemplated in an embodiment that the second player can be dealt cards without permitting the first player to see the cards of the second player.

Computer instructions (54) in the database (36) can then instruct the processor (12) to designate a soccer offensive player and a soccer defensive player. The designation of the soccer offensive and defensive players can be a random designation, or in an embodiment, a user can be permitted to designate the soccer offensive and defensive players.

It can also be contemplated that computer instructions (94) in the database (36) can instruct the processor (12) to permit a user to select a coin toss outcome using the input devices (24, 26).

Computer instructions (96) in the database (36) can then instruct the processor (12) to execute a simulated coin toss and obtain a coin toss outcome.

Computer instructions (98) in the database (36) can then instruct the processor (12) to compare the coin toss outcome with the outcome selected by the user, and to permit designation of the soccer offensive and defensive players by the user if the selected outcome matches the coin toss outcome.

Computer instructions (56) in the database (36) can instruct the processor (12) to permit selection of a first card by the soccer offensive player and to display the first card on the display devices (28, 30).

Computer instructions (58) in the database (36) can then instruct the processor (12) to electronically deal a replacement card for the first card. The computer instructions can allow the processor to repeat the process as play continues, alternating between the players.

It can be contemplated in an embodiment that the system can include computer instructions to repeat playing subsequent cards, sequentially, and repeat dealing the player replacement cards after each subsequent card is played to bring the card total to the same number of cards as originally dealt the each player.

FIG. 1 also depicts computer instructions (60) in the database (36), which can instruct the processor (12) to determine a game outcome based on the first card.

Computer instructions (62) in the database (36) can instruct the processor (12) to award winnings based on the bet and the game outcome.

If the first card is an offensive play card, computer instructions (64) in the database (36) can instruct the processor (12) to permit selection of a second card by the soccer defensive player and to display the second card on the display devices (28, 30). The computer instructions (60) for determining the game outcome can then determine the game outcome based on both the first card and the second card.

Computer instructions (66) in the database (36) can then instruct the processor (12) to electronically deal a replacement card for the second card.

FIG. 1 further depicts computer instructions (68) in the database (36), which can instruct the processor (12) to permit selection of one or more cards by the soccer offensive player to form an offensive time out hand, and to store the offensive time out hand in the database (36).

Computer instructions (70) in the database (36) can instruct the processor (12) to permit selection of one or more cards by the soccer defensive player to form a defensive time out hand, and to store the defensive time out hand in the database (36).

Computer instructions (71) in the database (36) can then be used to instruct the processor (12) to permit the soccer offensive player or the soccer defensive player to declare a time out prior to selecting a card for discard or play.

When a time out is declared, computer instructions (72) in the database (36) can instruct the processor (12) to permit selection of one or more cards by the soccer offensive player for exchange with cards in the offensive time out hand.

Computer instructions (74) in the database (36) can instruct the processor (12) to permit selection of one or more cards by the soccer defensive player for exchange with cards in the defensive time out hand.

FIG. 1 also depicts computer instructions (76) in the database (36), which can instruct the processor (12) to permit the soccer offensive player to elect to have a special plays card electronically dealt from the electronic deck of special plays cards (42) in lieu of selecting a card for discard or play.

Computer instructions (78) in the database (36) can then instruct the processor (12) to electronically deal a special plays card from the electronic deck of special plays cards (42) and to display the special plays card on the display devices (28, 30). Computer instructions (60) can then instruct the processor (12) to determine the game outcome based on the special plays card.

Computer instructions (80) in the database (36) can instruct the processor (12) to permit the soccer defensive player to elect to have a special plays card electronically dealt from the electronic deck of special plays cards (42), in response to the special plays card dealt to the soccer offensive player. The computer instructions (78) can then instruct the processor (12) to electronically deal a special plays card to the soccer defensive player. Computer instructions (60) can then instruct the processor (12) to determine the game outcome based on both special plays cards.

FIG. 1 also depicts computer instructions (82) in the database (36), which can instruct the processor (12) to permit input of team information from the input device (24) through the user interface (20) and network (14) to the server (10). The computer instructions (82) can further instruct the processor (12) to store the team information in the database (36), and to permit modification to the team information using the input devices (24, 26).

Team information can be used to personalize a team and add or remove simulated players, which can be fictional soccer players or representations of existing professional soccer players from various time periods.

Computer instructions (84) in the database (36) can instruct the processor (12) to display a simulated soccer field or "the pitch" complete with corner flags, on the display devices (28, 30). Computer instructions (86) in the database (36) can instruct the processor (12) to display a simulated play position on the simulated soccer field or "the pitch".

Computer instructions (88) in the database (36) can then instruct the processor (12) to update information on the display devices (28, 30), such as positions of the simulated play other similar information, or combinations thereof.

FIG. 1 also depicts computer instructions (90) in the database (36), which can instruct the processor (12) to display on the display devices (28, 30) one or more indicators for providing game information and statistics Computer instructions (92) in the database (36) can instruct the processor (12) to update the displayed indicators based on the game outcome.

FIG. 1 also shows computer instructions (100) in the database (36) which can instruct the processor (12) to permit the soccer offensive player and/or the soccer defensive player to select a card for discard.

FIG. 1 further depicts computer instructions (104) in the database (36), which can instruct the processor (12) to display a secondary bonus slot game if one or more play achievements occur. For example, the secondary bonus game can be engaged each time a goal is scored, each time a pass is kicked, each time a penalty is applied that allows a penalty kick when a foul is committed inside an 18 yard box, or for any other possible game outcome.

Computer instructions (106) in the database (36) can instruct the processor (12) to permit input of a bonus bet from the input device (24) and the monetary acceptance feature (32) through the user interface (20) and the network (14).

Computer instructions (108) in the database (36) can also instruct the processor (12) to electronically spin and stop reels of the secondary bonus slot game, or otherwise generate a graphical outcome of the secondary bonus slot game.

Computer instructions (110) in the database (36) cab then instruct the processor (12) to award bonus winnings based on the bonus bet and one or more play achievements.

An embodiment can further contemplate computer instructions to repeat playing subsequent cards, sequentially, and repeat dealing the player replacement cards after each subsequent card is played when the processor determines that each game outcome does not stop game play; computer instructions for instructing the processor to stop play when the electronic deck of playing cards is exhausted, which ends each half of the soccer game; and computer instructions for instructing the processor on a player's turn, to stop an offensive play comprising a movement when the player having its player's turn uses a defensive play card and wherein each offensive card represents a chess-like movement enabling the players to play soccer simultaneously while using a chess-like strategy.

While these embodiments have been described with emphasis on the embodiments, it should be understood that within the scope of the appended claims, the embodiments might be practiced other than as specifically described herein.

What is claimed is:

1. An online gaming system for simulating a soccer game with gambling elements, the system comprising:

a. a server with a processor;

b. a network in communication with the server;

c. at least one client device with at least one user interface in communication with the network, wherein the at least one client device has an input device, a display device, and a monetary acceptance feature; and d. a database in communication with the processor, the database comprising:

i. an electronic deck of playing cards comprising offensive play cards and defensive play cards;

ii. an electronic deck of special plays cards;

iii. computer instructions for instructing the processor to permit input by a first player of a first player bet and by a second player of a second player bet from each input device and the monetary acceptance feature through the user interface and the network to the server;

iv. computer instructions for instructing the processor to electronically deal a first plurality of cards from the electronic deck of playing cards to the first player and display the first plurality of cards on the display device of the client device of the first player;

v. computer instructions for instructing the processor to electronically deal a second plurality of cards from the electronic deck of playing cards to the second player without permitting the first player to see the cards of the second player;

vi. computer instructions for instructing the processor to designate a soccer offensive player and a soccer defensive player;

vii. computer instructions for instructing the processor to permit selection of a first card by the soccer offensive player and display the first card only to the soccer offensive player on the display device of the client device of the soccer offensive player;

viii. computer instructions for instructing the processor to electronically deal to the soccer offensive player a replacement card for the first card from the electronic deck of playing cards;

ix. computer instructions for instructing the processor to determine a game outcome based on the first card or the replacement card;

x. computer instructions for awarding winnings based on each bet and the game outcome;

xi. computer instructions to repeat playing subsequent cards, sequentially, and repeat dealing the player replacement cards after each subsequent card is played when the processor determines that each game outcome does not stop game play;

xii. computer instructions for instructing the processor to stop play when the electronic deck of playing cards is exhausted, which ends each half of the soccer game;

xiii. computer instructions for instructing the processor on a player's turn, to stop an offensive play comprising a movement when the player having its player's turn uses a defensive play card and wherein each offensive card represents a movement enabling the players to play soccer simultaneously while using a strategy;

xiv. computer instructions for instructing the processor to display a secondary bonus slot game when one or more play achievements occur;

xv. computer instructions for instructing the processor to permit input of a bonus bet from the input device and the monetary acceptance feature through the user interface and the network to the server; and xvi. computer instructions for instructing the processor to electronically spin reels of the secondary bonus slot game and stop the reels, and then award bonus winnings based on the bonus bet and the one or more play achievements.

2. The system of claim 1, wherein the database further comprises computer instructions that permit a player after using a defensive play card to move his goalie at least one goalie movement.

3. The system of claim 1, wherein the database further comprises:

a. computer instructions for instructing the processor to permit selection of a second card by the soccer defensive player for discard or in response to the offensive play card; and b. computer instructions for instructing the processor to electronically deal to the soccer defensive player a replacement card, wherein the computer instructions for instructing the processor to determine the game outcome based on the first and second cards.

4. The system of claim 1, wherein the database further comprises computer instructions for instructing the processor to permit the soccer offensive player or the soccer defensive player to declare a time out.

5. The system of claim 1, wherein the database further comprises computer instructions for instructing the processor to permit selection of at least one card by a player during the player's turn to form a time out hand to interchange with at least one of the offensive cards of the player or at least one defensive card of the player.

6. The system of claim 1, wherein the database further comprises:

a. computer instructions for instructing the processor to permit the soccer offensive player to elect to perform a special play using a special play card in lieu of selecting the first card; and b. computer instructions for instructing the processor to electronically deal a first special play card from the electronic deck of special play cards and display the first special play card on the display device, wherein the computer instructions for instructing the processor can determine the game outcome based on the first special play card.

7. The system of claim 1, wherein the database further comprises:

a. computer instructions for instructing the processor to permit the soccer defensive player to elect to perform a special play response in response to the first special play card; and b. computer instructions for instructing the processor to electronically deal a second special play card from the electronic deck of special play cards and display the second special play card on the display device, wherein the computer instructions for instructing the processor can determine the game outcome based on the first special play card and the second special play card.

8. The system of claim 1, wherein the database further comprises:

a. computer instructions for instructing the processor to permit input of team information from the input device through the user interface and the network to the server;

b. computer instructions for instructing the processor to store the team information in the database; and c. computer instructions for instructing the processor to permit modification of the team information using the input device.

9. The system of claim 1, wherein the database further comprises:

a. computer instructions for instructing the processor to display on the display device a simulated soccer field comprising a gridiron, a score indicator, a possession indicator, a half indicator, two goals, or combinations thereof;

b. computer instructions for instructing the processor to display on the display device a simulated center field circle on the simulated soccer field; and c. computer instructions for instructing the processor to update on the display device a position on the simulated soccer field, a score, a possession, a half, or combinations thereof, during play and each movement further enabling players to observe simulated players during play.

10. The system of claim 1, wherein the database further comprises: computer instructions for instructing the processor to tally and display on the display device, all free kicks, all free kicks missed, all kicked goals, all kicked goals missed, all non-hand non-kicked goals, all non-hand, non-kicked goals missed, in bounds pass, out of bounds kick, side kick, penalties, or combinations thereof.

11. The system of claim 1, wherein the computer instructions for instructing the processor to designate the soccer offensive player and the soccer defensive player comprise:

a. computer instructions for instructing the processor to permit selection of a coin toss outcome from the input device through the user interface and the network to the server, forming a selected coin toss outcome;

b. computer instructions for instructing the processor to execute a simulated coin toss and display the coin toss outcome on the display device; and c. computer instructions for instructing the processor to compare the coin toss outcome with the selected coin toss outcome and to permit designation of the soccer offensive player and the soccer defensive player from the input device through the user interface and the network to the server if the coin toss outcome matches the selected coin toss outcome.

12. The system of claim 1, wherein the database further comprises:

a. computer instructions for instructing the processor to permit selection by the offensive player of at least one offensive card for discard, to permit selection by the defensive player of at least one defensive card for discard, or combinations thereof; and b. computer instructions for instructing the processor to electronically deal a replacement card from the electronic deck of playing cards to replace the at least one offensive card for discard, the at least one defensive card for discard, or combinations thereof.

13. The system of claim 1, wherein the monetary acceptance feature is a means for accepting credit cards, a means for accepting debit cards, a means for accepting currency, a means for accepting facility-specific credits, a credit card reader, a bill and coin insertion slot, a reader for cards issued by casinos, or combinations thereof.

14. The system of claim 1, wherein the second player is a simulated player controlled by the processor.

15. The system of claim 1, wherein the client device comprises: the client device, a ticket printer, a blue tooth connection, an infra-red connection and a denomination indicator/change switch.

16. The system of claim 1, wherein the computer instructions to repeat playing subsequent cards, sequentially, and repeating dealing the player replacement cards after each subsequent card is played.

17. The system of claim 1, wherein the one or more play achievements comprise scoring one or more goals, achieving one or more offensive or defensive plays, or scoring.

18. The system of claim 1, wherein each bet is a bet related to a winner of the soccer game, a bet specifying which team will have more goals at a certain goal in the soccer game, a bet related to the game outcome, a bet related to amounts of goals scored, a bet related to a spread in goals, a bet relate to goal totals, a bet related to individual plays or game outcomes, a single-play bet, a bet that persists for a simulated possession, or a bet that persists for an extended portion of the soccer game.

19. The system of claim 1, wherein the database further comprises: computer instructions to instruct the processor to play a video, an animation, or combinations thereof that depict a representation of the game outcome.

20. The system of claim 1, wherein the secondary bonus slot game is engaged each time a goal is scored, each time a pass is kicked, or each time a penalty is applied that allows a penalty kick when a foul is committed inside an eighteen yard box.

* * * * *